US006193012B1

(12) United States Patent
Olivas

(10) Patent No.: US 6,193,012 B1
(45) Date of Patent: Feb. 27, 2001

(54) LADDER CADDIE

(76) Inventor: Joseph Albert Olivas, 1118 Roosevelt St., Fairfield, CA (US) 94533

( * ) Notice: Subject to any disclaimer, the term of this patent is extended or adjusted under 35 U.S.C. 154(b) by 0 days.

(21) Appl. No.: 09/256,506

(22) Filed: Feb. 22, 1999

Related U.S. Application Data

(60) Provisional application No. 60/101,086, filed on Sep. 18, 1998.

(51) Int. Cl.[7] ..... E04G 1/00; E04G 3/00; A45F 3/14

(52) U.S. Cl. ..... 182/129; 224/257

(58) Field of Search ..... 182/129, 116, 182/20; 224/250, 257, 258, 264, 600

(56) References Cited

U.S. PATENT DOCUMENTS 2,394,805 * 2/1946 Reishus ..... 224/250
4,471,969 * 9/1984 Zabala et al. ..... 182/20 X
4,558,807 * 12/1985 Jackson ..... 224/258 X
4,942,995 * 7/1990 Myers ..... 224/264 X
5,203,482 * 4/1993 Puff ..... 224/257
5,433,288 * 7/1995 James ..... 182/3
5,511,285 * 4/1996 Bush et al. ..... 16/114 R

* cited by examiner

*Primary Examiner*—Daniel P. Stodola
*Assistant Examiner*—Hugh B. Thompson

(57) ABSTRACT

An adjustable shoulder carrying strap for longitudinal attachment to a ladder during transport. It provides for a balanced load of an otherwise cumbersome utilitarian device. The strap is adapted to be attached to a ladder by fasteners on the ends of the strap. Assembly includes mechanisms attached to a side surface of the ladder capable of accepting the fasteners attached to the strap thus providing support enabling a single individual to move a long heavy ladder conveniently into position for use at a work site.

1 Claim, 6 Drawing Sheets

LADDER CADDIE

This application claims benefit of U.S. provisional application Ser. No. 60/101,086, filed Sep. 18, 1998.

BACKGROUND OF THE INVENTION

1. Field of the Invention

This invention relates to an adjustable removable shoulder strap attached to a ladder for use in transporting same to save set-up time and reduce human energy expended to perform tasks requiring use of a ladder.

2. Background Art

In the past, the manufacture of a ladder has not addressed any method to facilitate the carrying of a ladder from a storage area or vehicle to the exact location where it was to be used. The present use of a ladder requires that, first, it be transported by hand to the work site with subsequent trips needed to place tools and materials at that site. This involves transporting a heavy cumbersome ladder over long distances to a work site not readily accessible by vehicle.

Advances in manufacture have resulted in a diverse range of ladder design. These include ladders intended for manhole, billboard and shelf use to industrial heavy duty (500 pound capacity) extension ladders. Their weights vary from 9–22 pounds for a four foot ladder to 127 pounds for a twenty-four foot super heavy duty aluminum extension ladder.

Carry straps currently used to transport moderately heavy loads such as luggage, garment bags, sample cases, golf clubs, tool kits, camera equipment and other such items are designed to accomodate items normally not more than three feet in height for a golf bag and small varying three dimensional configurations for luggage and garment gags. The device invented by puff (U.S. Pat. No. 5,203,482) accomodates these configurations within design limitation for light to moderate weights while the device invented by Jackson (U.S. Pat. No. 4,558,807) is designed for a very small item weighting approximately one-half to one pound. Such a device cannot sustain the weights the ladder caddie is designed to accommodate, even though both employ use of straps and "D" rings that are attached to an item to be transported.

In view of these considerations there is a need for a new shoulder strap designed specifically for use in transporting of ladders.

BRIEF SUMMARY OF THE INVENTION

Summary

An adjustable shoulder strap that is mounted on a ladder, be it wood, metal, or fiberglass to improve the method used to transport the ladder. In many cases the ladder can exceed weights from 50 to 100 pounds. Said shoulder strap balances the ladder on the shoulder of the individual. It frees use of hands so that rather than one item being carried, the ladder, two or three items, tools or materials, can be transported at once.

Object of the Invention

Save time and reduce human energy expended in setting-up a site to perform tasks needing use of a ladder.

The present invention involves an improvement to an otherwise conventional ladder of the type employed by a myriad of users, be they governmental, industrial, commercial, agricultural or home entities. According to the invention the ladder is provided with an adjustable shoulder strap that is attached equidistant from the ladders centric point. As part of the invention, the strap is provided with severally identified items projecting longitudinally on one side of a framework consisting of two parallel sidepieces connected by a series of rungs on which a person climbs. The attachment devices may take the form of "D" rings and steel clips fixed in position on the ladder to facilitate use of the ladder caddie shoulder strap.

The attachment devices of the improved ladder will allow a shoulder strap with non-slip padding to be attached to the ladder through use of snaps that are part of the shoulder strap. One end of the shoulder strap is connected to one of the attachment devices, "D" rind, while the other snap is connected to the second device, "D" ring.

When the shoulder strap is snapped onto the ladder attachment devices, the shoulder strap forms a balanced sling that can pass over the shoulder of the person who will use the ladder. That person will than have free use of his/her hands to simultaneously transport tools and materials to the site where the ladder is needed.

Another feature of this invention is that it allows persons of smaller stature to transport a cumbersome ladder that they previously could not wield. The weight of the ladder is balanced on the shoulder thus allowing for greater weight to be carried for longer distances.

When the shoulder strap is not is use it can either be removed or adjusted to be flush with the parallel sidepiece to which it is connected thus allowing for greater safety.

The invention may be described with greater clarity and particularity by reference to the accompanying drawings.

DETAILED DESCRIPTION OF THE INVENTION

Figure 1:
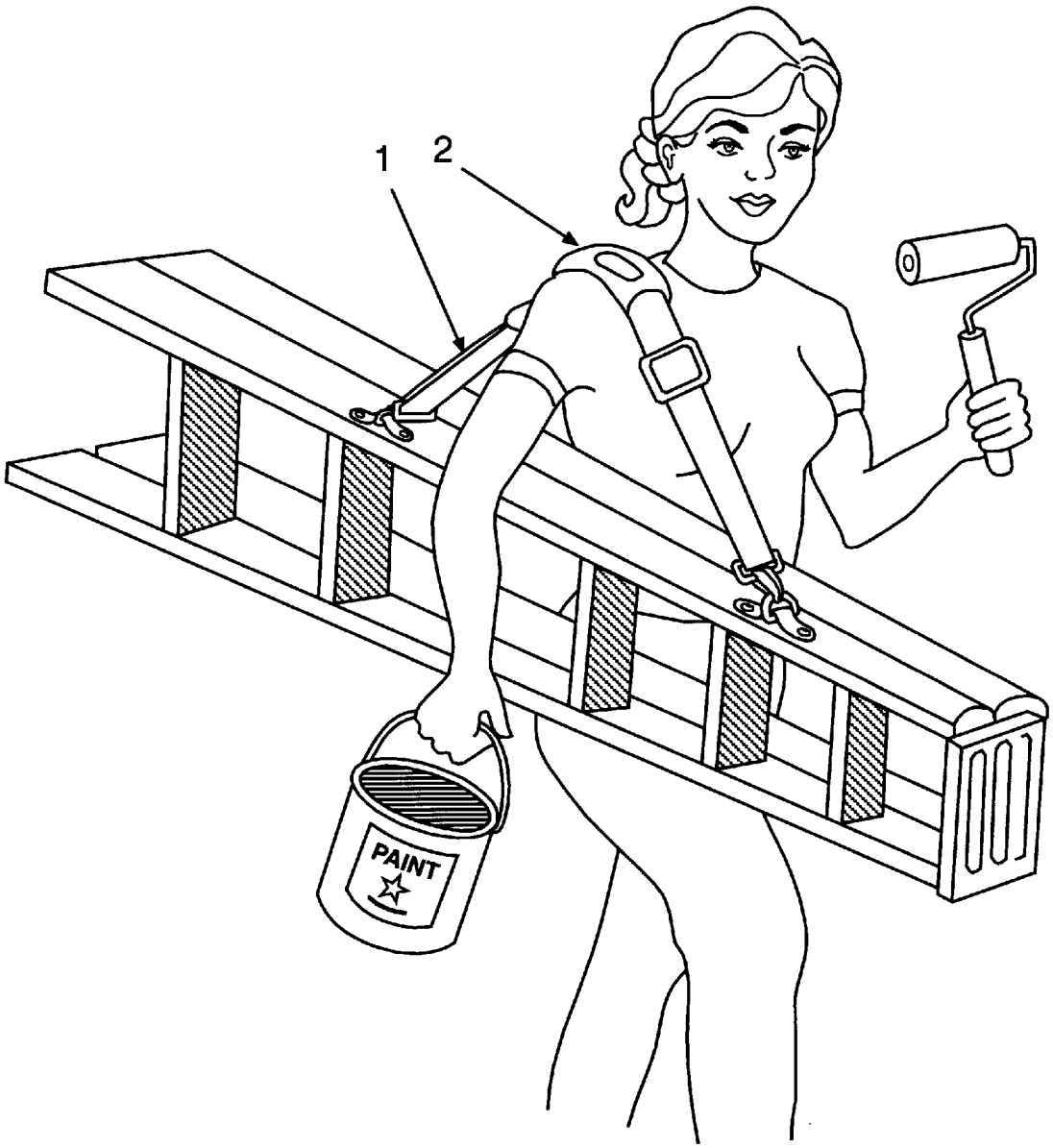
FIG. 1 and FIG. 2 are a perspective view showing a ladder caddie as it would be used to carry a ladder in accordance with the instant inventor.
Figure 2:
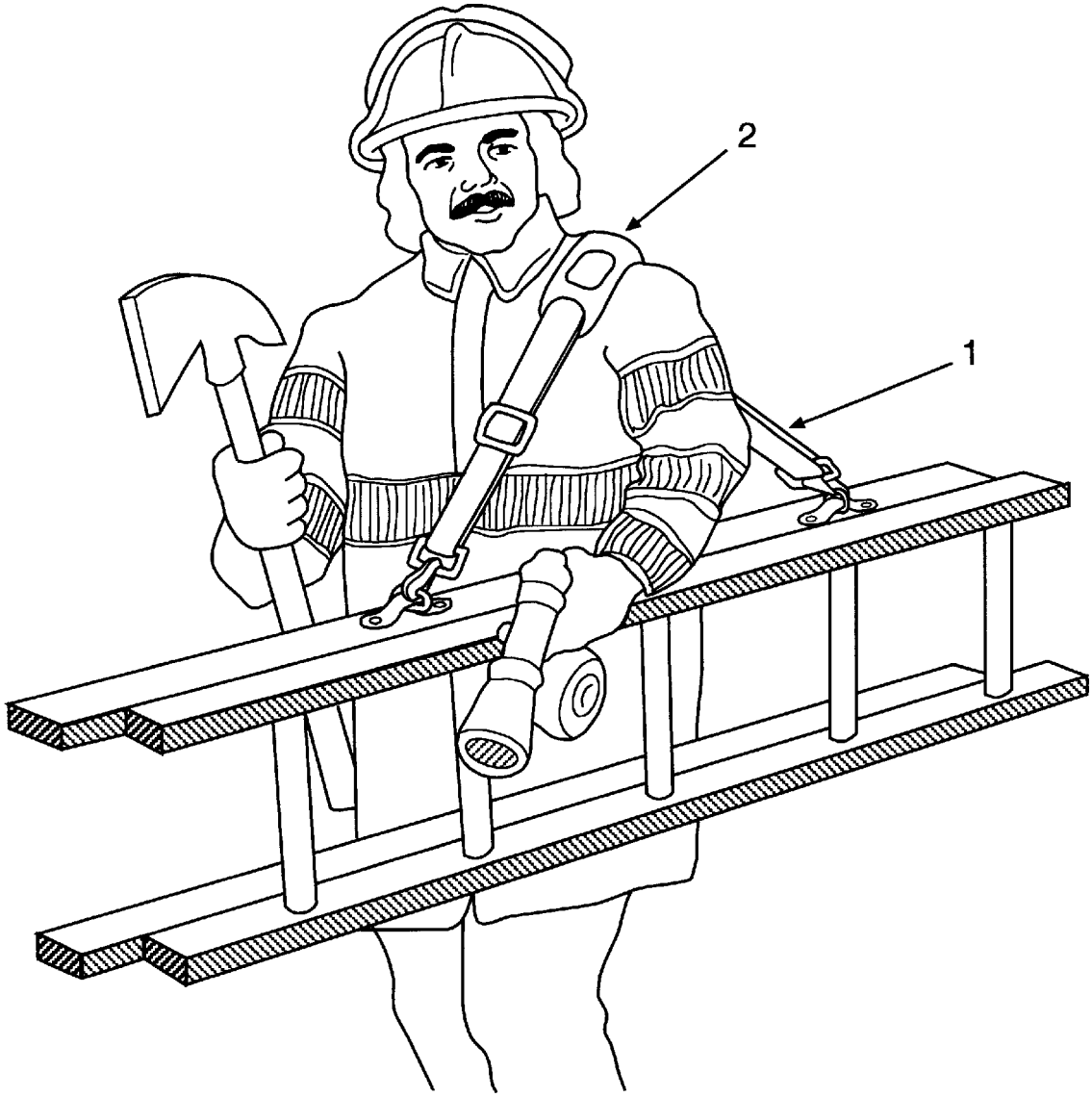
Figure 8:
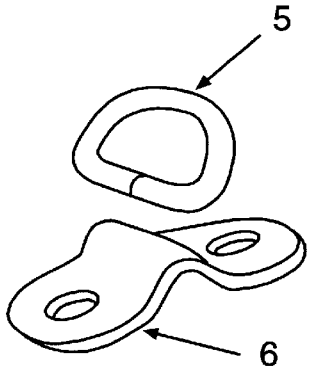
FIGS. 8–10 show elements of the D ring assembly.
Figure 9:
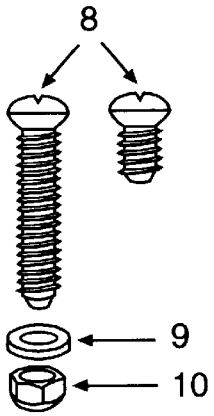
Figure 10:
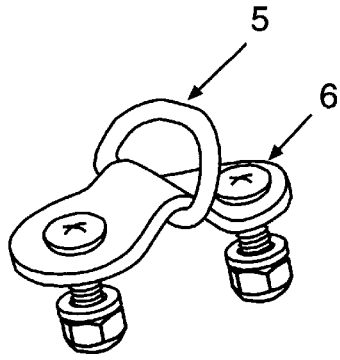

Referring now to FIG. 1 and FIG. 2. FIG. 1 and FIG. 2 disclose a perspective view of a complete strap assembly 1 of pliable material that includes a non-slip pad 2 generally used to carry a ladder in accordance with the instant inventor. The strap is adjustable which permits suspending of the ladder from one's shoulder, thus supporting the weight of the ladder to which the strap has been attached by fasteners. The ladder caddie is approximately twenty-fix inches long by one and one-half inches wide at it's shortest longitudinal configuration. It's longest longitudinal form is approximately forty inches.

Figure 3:
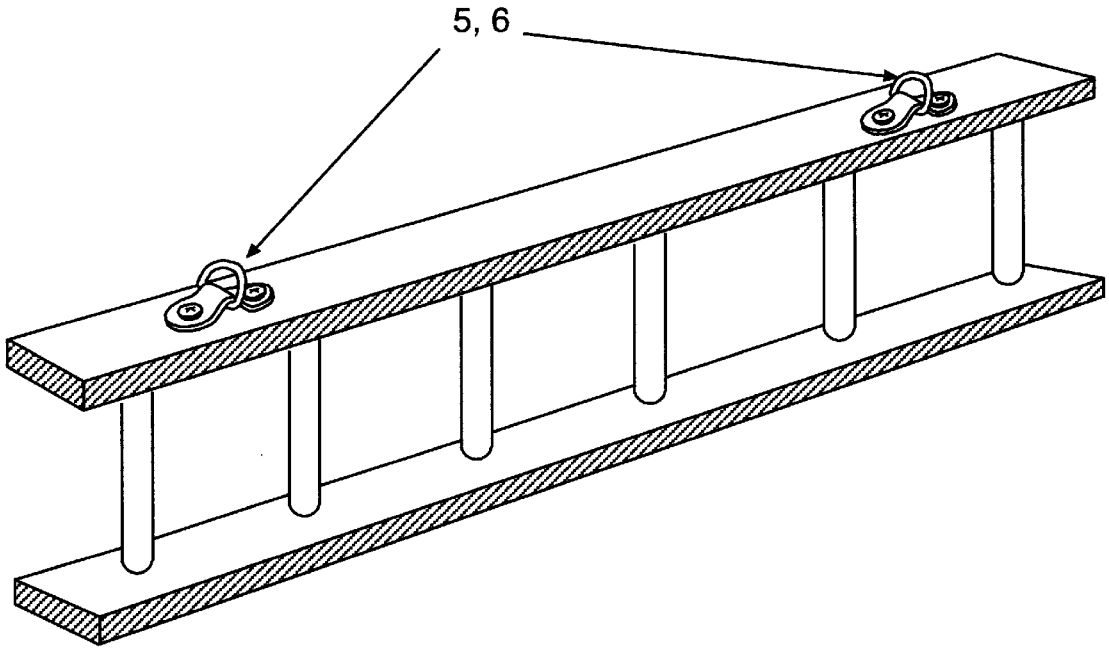
FIG. 3 shows he typical load attaching fixtures needed to mount the "D" ring onto a ladder and how the "D" ring will be mounted on a ladder.

Referring now to FIG. 3. FIG. 3 shows the "D" ring assembly instruction. The "D" ring 5 is slipped under a steel clip 6 and placed over holes drilled onto the ladder that are strategically placed from the balance point 7 of the of the ladder. The "D" ring and steel clip are then attached to the ladder through employment of Phillips head screws 8 (1¼" for wood ladders and ½" for aluminum and fiberglass ladders), flat washers 9, and nylon self locking nuts 10.

Figure 4:
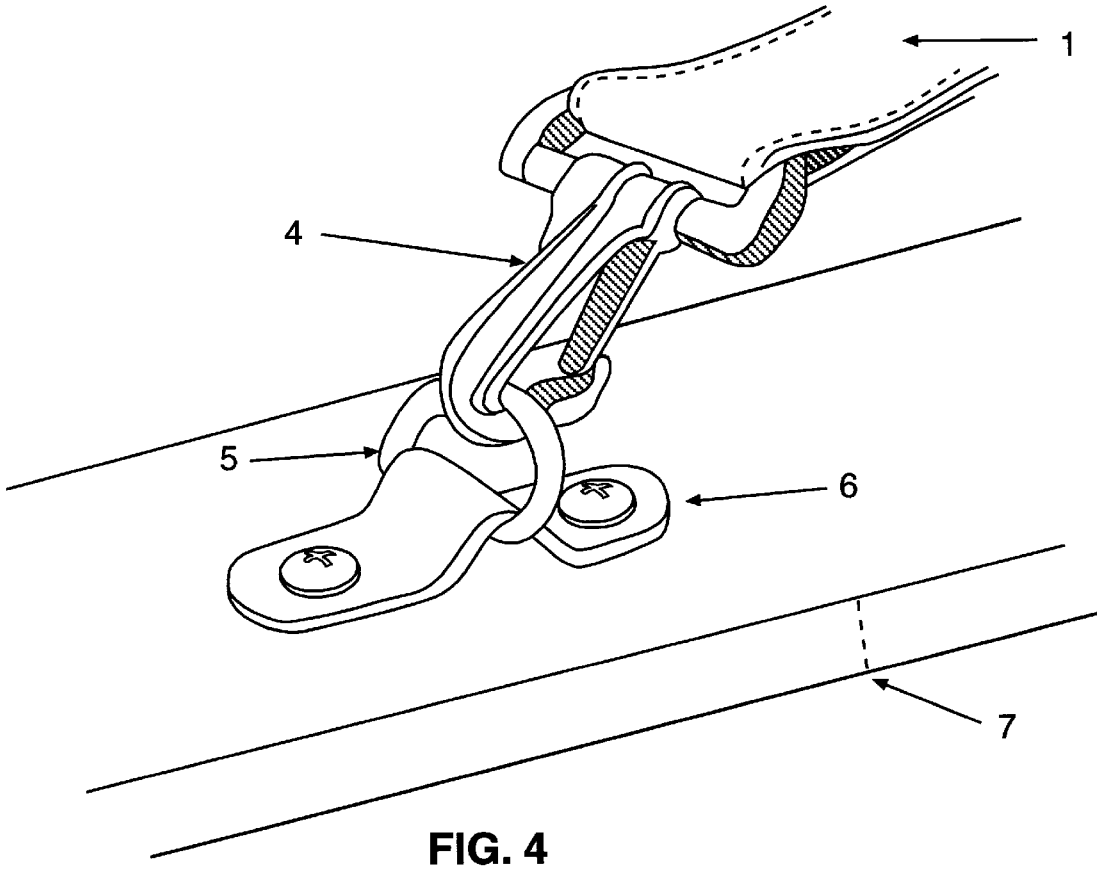
FIG. 4 shows the strap assembly attached to the "D" ring.

Referring now to FIG. 4. FIG. 4 shows the completed "D" ring attachment, when the strap is to be utilized, the fastener 4 is attached to the "D" ring 5 which is secured to the ladder by a steel clip 6 strategically located from the balance point 7 of the ladder.

Figure 5:
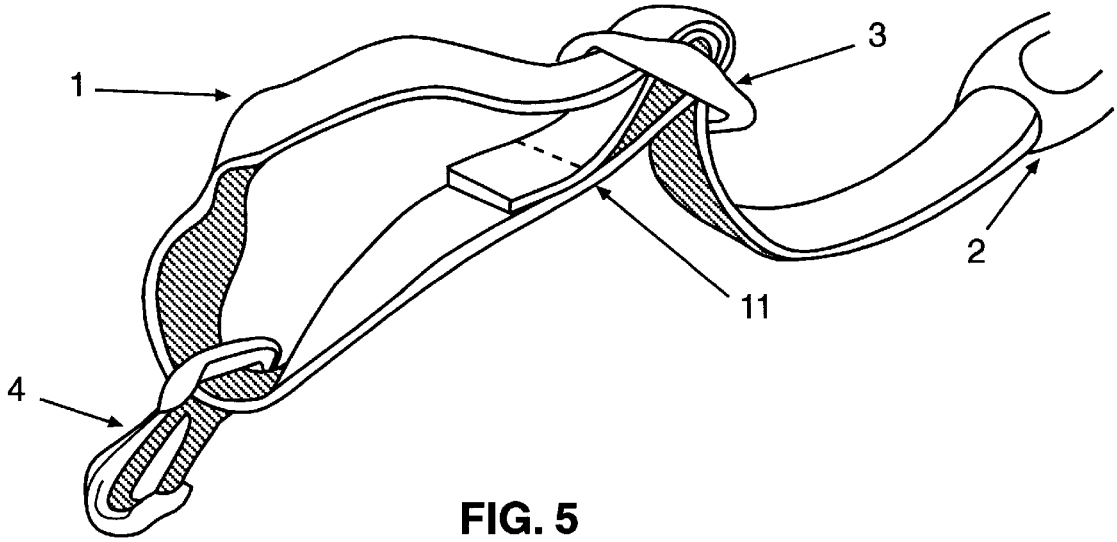
FIG. 5 shows the stiching location and the typical load attaching fixtures needed to assemble the strap to be attached to the "D" ring.

Referring now to FIG. 5. FIG. 5 shows the fastener 4 attached to the end section of the strap by heavy duty stiching 11. FIG. 5 also includes the non-slip pad 2 and conventional strap length adjustment means 3 comprising a slide formed as a rectangular frame member having a tongue extending across the middle of the frame member that permits length adjustment. The fastener 4 used to attach the strap to the ladder to be carried as depicted in FIG. 5 is a snap hook 4 of high impact plastic. The strap adjustment means 3 and the fastner 4 are inserted onto the strap prior to stiching 11.

Figure 6:
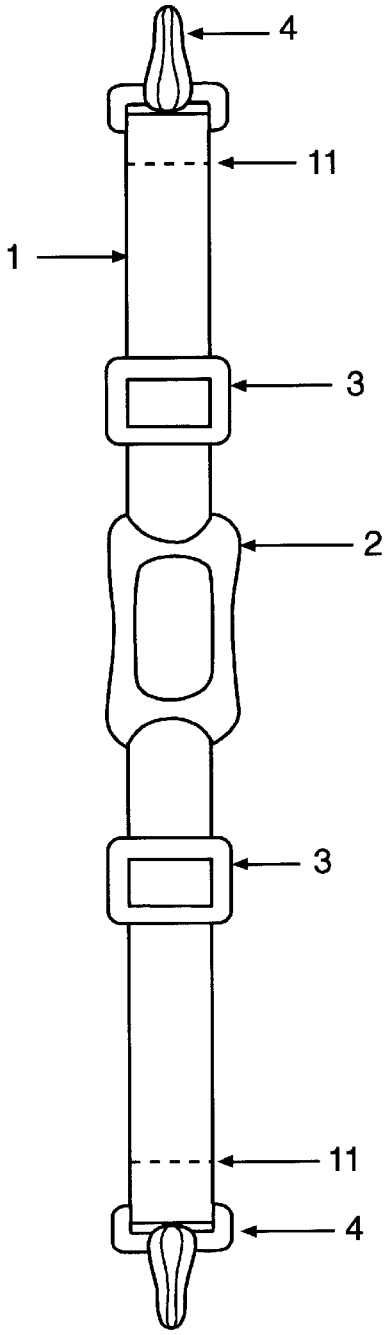
FIG. 6 shows a top view of the ladder caddie as it would appear laid out flat on a table and the major components attached to the strap before stiching is completed.
Figure 11:
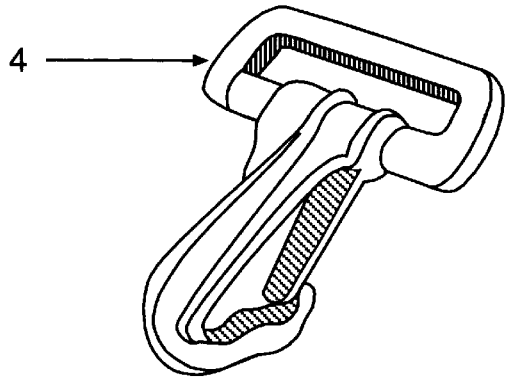
FIGS. 11–13 show elements of a strap assembly.
Figure 12:
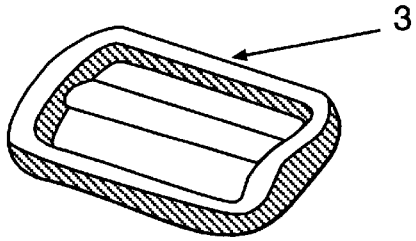
Figure 13:
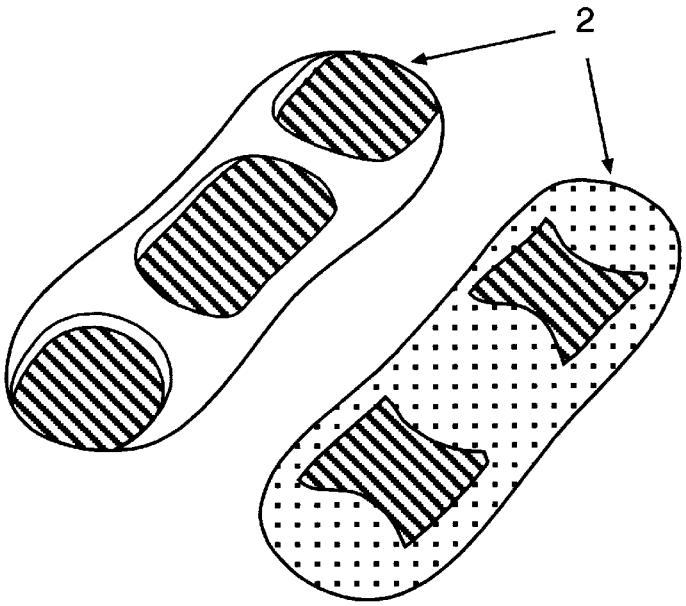

Referring now to FIG. 6. FIG. 6 shows the middle section of the shoulder strap 2 that employs a non-slip pad that is dimpled on it's underside surface to ensure functionality. The non-slip pad is inserted onto the strap prior to stiching. The oblong non-slip pad is composed of flexible rubber material approximately five and five-eights inches long and two inches wide. It's design ensures safety and comfort for the use it is inserted onto the strap through slots on either end of the pad and positioned at approximately the mid-point of the strap.

Figure 7:
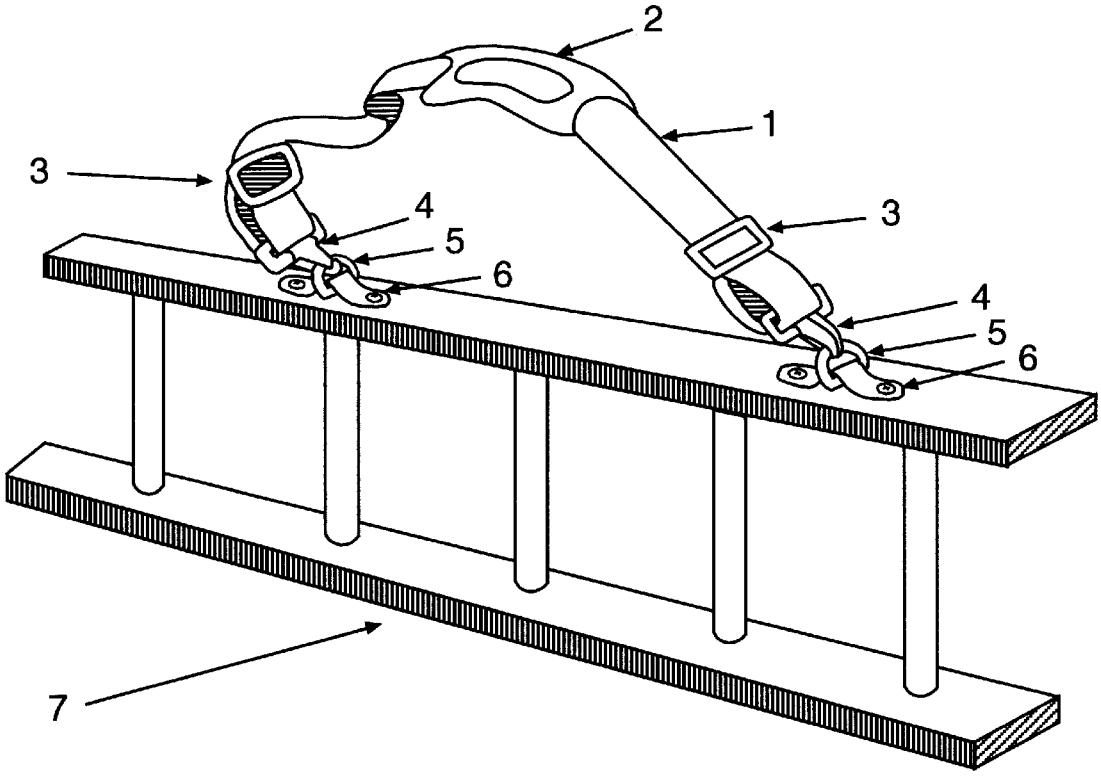
FIG. 7 shows a fully assembled ladder caddie attached to a ladder.

Referring now to FIG. 7. FIG. 7 shows the fully assembled ladder caddie as it attaches to the ladder.

What is claimed is:

1. A ladder system consisting of a shoulder strap assembly in combination with a ladder which has two side rails and a plurality of rungs therebetween, and two engaging members attached to an outer face of a side surface of one of the rails at opposite ends of said ladder, with said shoulder strap assembly comprising first and second end sections of strap material, wherein each of said end section has a length, a width, a first end and second end whereby each of said end sections includes a fastener assembly which longitudinally secures said shoulder strap assembly to said ladder at approximately opposite end sections of the ladder, wherein said engaging members engage said fastener assemblies, said shoulder strap assembly having an intermediate section whereby the intermediate section can be positioned over a shoulder of a user such that said intermediate section distributes a load of the ladder over the shoulder of the user, and said shoulder strap assembly further including a strap length adjusting means secured to said shoulder strap assembly to accommodate the height of the user.

* * * * *